US012150534B2

(12) United States Patent
Chu

(10) Patent No.: US 12,150,534 B2
(45) Date of Patent: Nov. 26, 2024

(54) HAIR CURLING DEVICE

(71) Applicant: Peng-Fei Chu, Taipei (TW)

(72) Inventor: Peng-Fei Chu, Taipei (TW)

( * ) Notice: Subject to any disclaimer, the term of this patent is extended or adjusted under 35 U.S.C. 154(b) by 1057 days.

(21) Appl. No.: 16/922,188

(22) Filed: Jul. 7, 2020

(65) Prior Publication Data

US 2021/0244151 A1 Aug. 12, 2021

(30) Foreign Application Priority Data

Feb. 7, 2020 (CN) ..... 202020155224.0

(51) Int. Cl.
*A45D 1/04* (2006.01)
*A45D 1/28* (2006.01)
*A45D 2/36* (2006.01)

(52) U.S. Cl.
CPC ..... *A45D 1/04* (2013.01); *A45D 1/28* (2013.01); *A45D 2/367* (2013.01); *A45D 2001/045* (2013.01)

(58) Field of Classification Search
CPC ... A45D 1/04; A45D 1/28; A45D 6/20; A45D 2/367; A45D 2001/045
See application file for complete search history.

(56) References Cited

U.S. PATENT DOCUMENTS 4,520,256 A * 5/1985 Doyle ..... A45D 1/04 200/332.2
2005/0183283 A1* 8/2005 Evanyk ..... A45D 1/04 34/91
2009/0084396 A1* 4/2009 Jerome ..... A45D 1/04 132/224
2010/0017953 A1* 1/2010 O'Keeffe ..... G06Q 10/0639 219/480
2013/0019892 A1* 1/2013 Cheung ..... A45D 4/12 132/229
2015/0189965 A1* 7/2015 Chung ..... A45D 6/02 132/230
2016/0295985 A1* 10/2016 Bursey ..... A45D 1/04

* cited by examiner

*Primary Examiner* — Dana Ross
*Assistant Examiner* — Kuangyue Chen
(74) *Attorney, Agent, or Firm* — Demian K. Jackson; Jackson IPG PLLC

(57) ABSTRACT

A hair curling device includes a hair curling mechanism including two pivot holes on left and right sides respectively; and a covering plate including two pivots on left and right sides respectively, the pivots being configured to insert into the pivot holes so as to pivotally secure the covering plate to the hair curling mechanism. The covering plate is configured to close or open the hair curling mechanism. When the covering plate is completely open, the hair curling mechanism is not covered by said covering plate.

10 Claims, 4 Drawing Sheets

HAIR CURLING DEVICE

BACKGROUND OF THE INVENTION

1. Field of the Invention

The invention relates to hair curling devices and more particularly to a hair curling device having an improved heat retaining characteristic.

2. Description of Related Art

Conventionally, a clip or a rubber band is used to secure the hair to a hair curling cylinder for a period of time for curling hair. Alternatively, an external heat source (e.g., a handheld hair dryer or a hood dryer) is used to curl the hair.

Some hair curling cylinders are heated by a heating seat. Alternatively, the hair curling cylinder has a Universal Serial Bus (USB) receptacle so that a USB plug can be inserted into the USB receptacle to charge the hair curling cylinder. After the hair curling cylinder has been heated to a set temperature, the hair is curled onto the hair curling cylinder and a clip or a rubber band is used to secure the hair to the hair curling cylinder for a period of time. As a result, the hair is curled.

Hair curling cylinders commercially used are without clip. Thus, additional clip or rubber band is required to fasten the hair onto the hair curling cylinders. Another hair curling cylinders equipped with a clip are also commercially available. When the clip is pressed, the clip is leveled an open gap relative to the hair curling cylinder. A user may curl the hair into the gap between the hair curling cylinder and the clip. While it is easy to use and is not easy to lose the clip, the implementation may hinder the hair curling operation because the clip stands block the hand motion of curling the hair.

In view of above, the present inventor has worked deeply on the issues and aggressively searched for a solution based on years' experience in the related field, and through endeavor of repeated study and trial, eventually successfully develops a hair curling device having characteristics including being easy to use, high performance, and being durable in order to overcome the drawbacks of the conventional art.

SUMMARY OF THE INVENTION

It is therefore one object of the invention to provide a hair curling device having characteristics of being easy to use, safe, durable and retaining heat.

For achieving above and other objects, the invention provides a hair curling device comprising a hair curling mechanism including two pivot holes on left and right sides respectively; and a covering plate including two pivots on left and right sides respectively, the pivots being configured to insert into the pivot holes to pivotally secure the covering plate of the hair curling mechanism; wherein the covering plate is configured to close or open mode from the hair curling mechanism; and wherein when the covering plate is completely open, the hair curling mechanism is not covered by the covering plate.

According to an embodiment of the present invention, the hair curling mechanism further comprises a closing cap including a front closing cavity and a rear opening cavity; and wherein the covering plate further comprises a rear projection, when the covering plate is closed, the rear projection being locked in the front closing cavity, and when the covering plate is open, the rear projection is locked in the rear opening cavity.

According to an embodiment of the present invention, the hair curling mechanism further comprises a sealing cap having a cavity; and wherein the covering plate further comprises a front projection, the front projection being locked in the cavity of the sealing cap when the covering plate is closed.

According to an embodiment of the present invention, wherein the hair curling mechanism is electrically connected to an adapter.

According to an embodiment of the present invention, wherein the covering plate has a section of a curved triangle, a half circle or a polygonal.

According to an embodiment of the present invention, further comprising a heat retaining coating formed on an inner surface of the covering plate for slow down to decrease the temperature drop of the heating unit.

According to an embodiment of the present invention, wherein the hair curling mechanism further comprises a power supply unit and a heating unit; wherein the heating unit is a polyimide (PI) film heater; and wherein the power supply unit includes a control circuit board, a power connection terminal and a power indicator both connected to the control circuit board.

According to an embodiment of the present invention, wherein the power connection terminal is a socket or a USB receptacle.

It is another object of the invention to provide a hair curling device, comprising a power supply unit including a control circuit board, a power connection terminal and a power indicator both connected to the control circuit board; a central tube for receiving the power supply unit; a heating unit disposed externally of the central tube, the heating unit being connected to the power supply unit so that the power supply unit is capable of supplying electricity to the heating unit; a sealing cap disposed at one end of the central tube, the sealing cap including a main hole for allowing the power connection terminal to be revealed; a closing cap disposed at the other end of the central tube opposite to the sealing cap; a curling cylinder put on the heating unit; and a covering plate pivotally secured to the closing cap; wherein the covering plate is configured to close or open mode from the curling cylinder; and wherein when the covering plate is completely open, the curling cylinder is not covered by the covering plate.

According to an embodiment of the present invention, wherein the closing cap includes two pivot holes on left and right sides respectively; and wherein the covering plate includes two pivots on left and right sides respectively, the pivots being configured to insert into the pivot holes.

According to an embodiment of the present invention, wherein the closing cap includes a front closing cavity and a rear opening cavity; and wherein the covering plate further comprises a rear projection, when the covering plate is closed, the rear projection being locked in the front closing cavity and when the covering plate is open, the rear projection is locked in the rear opening cavity.

According to an embodiment of the present invention, wherein the sealing cap includes a cavity; and wherein the covering plate further comprises a front projection, when the covering plate is closed, the front projection being locked in the cavity of the sealing cap.

According to an embodiment of the present invention, wherein the surface of the curling cylinder includes a plurality of bristles.

According to an embodiment of the present invention, wherein the surface of the curling cylinder is a comb-tooth shaped or a smooth surface.

According to an embodiment of the present invention, wherein the power supply unit further comprises a thermostat connected to the control circuit board; and wherein the heating unit is a polyimide (PI) film heater.

The invention has the following advantages and benefits in comparison with the conventional art: the covering plate is pivotal and can be open without interrupting the hair curling operation. A heat retaining coating is formed on an inner surface and is adapted to decrease the rate of temperature drop of the heating unit. The heating unit is implemented as a PI film heater which can generate an optimum heat in use. The PI film heater is adapted to bend so that the generated heat can be gradually transferred to the external.

The above and other objects, features and advantages of the invention will become apparent from the following detailed description taken with the accompanying drawings.

DETAILED DESCRIPTION OF THE INVENTION

Figure 1:
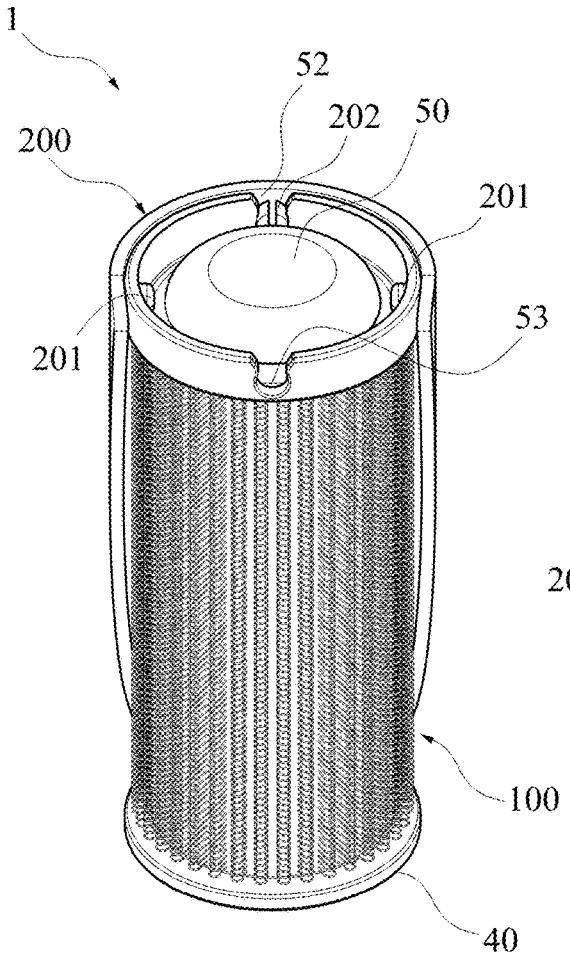
FIG. 1 is a perspective view of a hair curling device according to a preferred embodiment of the invention with the closing cap on top.
Figure 2:
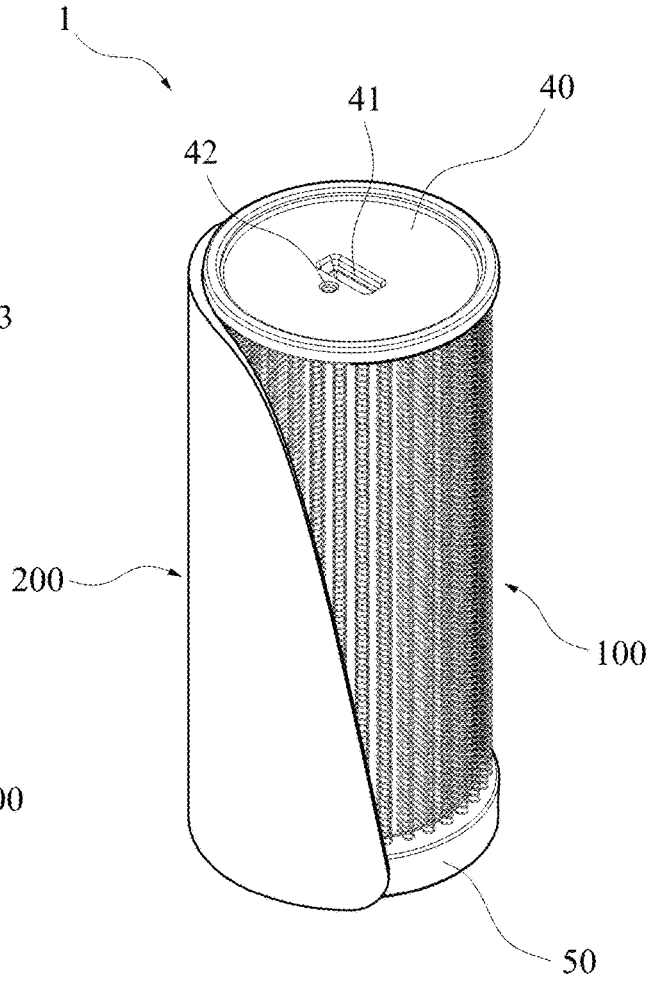
FIG. 2 is a perspective view of the hair curling device according to the preferred embodiment of the invention with the sealing cap on top.

Referring to FIGS. 1 to 4, a hair curling device 1 in accordance with a preferred embodiment of the invention comprises a hair curling mechanism 100 and a covering plate 200 pivotally secured to the hair curling mechanism 100, the covering plate 200 being configured to close or open mode from the hair curling mechanism 100. The hair curling mechanism 100 includes a power supply unit 10, a central tube 20, a heating unit 30, a sealing cap 40, a closing cap 50 and a curling cylinder 60. The hair curling mechanism 100 can be shaped as a cylinder, an elliptical cylinder or any shape depending on applications other than the cylinder as shown. Likewise, the covering plate 200 may be shaped as any shape as long as it can close or open from the hair curling mechanism 100.

The power supply unit 10 includes a control circuit board 11, a power connection terminal 12, a power indicator 13 and a thermostat 14 all connected to the control circuit board 11. The power connection terminal 12 may be implemented as a socket or a USB receptacle. Any type as Type A, Type B, Type-C, Micro-A, Micro-B, Mini-A or Mini-B of the Universal Serial Bus (USB) can be used. While the power connection terminal 12 adapt as a USB receptacle, preferably the Type-C USB receptacle is recommend. Further, when the power supply unit 10 is in condition of charge, the power indicator 13, preferably a light-emitting diode (LED) will be light up. The thermostat 14 can prevent the hair curling device 1 from being overheated or when the hair curling device 1 has a temperature lower than a set value, the thermostat 14 will activates the power supply unit 10 to heat the hair curling device 1.

The central tube 20 of the hair curling mechanism 100 is configured to receive the power supply unit 10. The sealing cap 40 is mounted on one end of the central tube 20, and the closing cap 50 is mounted on the other end of the central tube 20. The sealing cap 40 includes a main hole 41 for allowing the power connection terminal 12 to be revealed, and a light hole 42 to allow the light emitted by the power indicator 13 to pass through.

The heating unit 30 is a thin, cylindrical plate and connected to the power supply unit 10 so that the power supply unit 10 may supply electricity to the heating unit 30. The heating unit 30 is wrapped on the outside of the central tube 20. In the embodiment, the heating unit 30 is a polyimide (PI) film heater and has an excellent heating effect. The PI film heater is adapted to bend to enable the generated heat can be gradually evenness transferred to the external.

The curling cylinder 60 wrapped on the heating unit 30 and also the central tube 20. In the embodiment, the outside of curling cylinder 60 includes a plurality of bristles 61, or is a comb-tooth shaped or a smooth surface (not shown).

The sealing cap 40 is mounted on one end of the hair curling mechanism 100 and the closing cap 50 is mounted on the other end of the hair curling mechanism 100. The covering plate 200 is pivotally secured to one end of the hair curling mechanism 100, i.e., on the closing cap 50 so that the covering plate 200 may be disposed to open from the curling cylinder 60, the cavity 202 is locked in the rear projection 53, or close from the curling cylinder 60, the cavity 202 is locked in the front projection 52. In the embodiment, the covering plate 200 is a curved triangle. A heat retaining material is coating formed on an inner surface of the covering plate 200 that facing the curling cylinder 60 for slow down to decrease the temperature drop of the heating unit 30.

Figure 5:
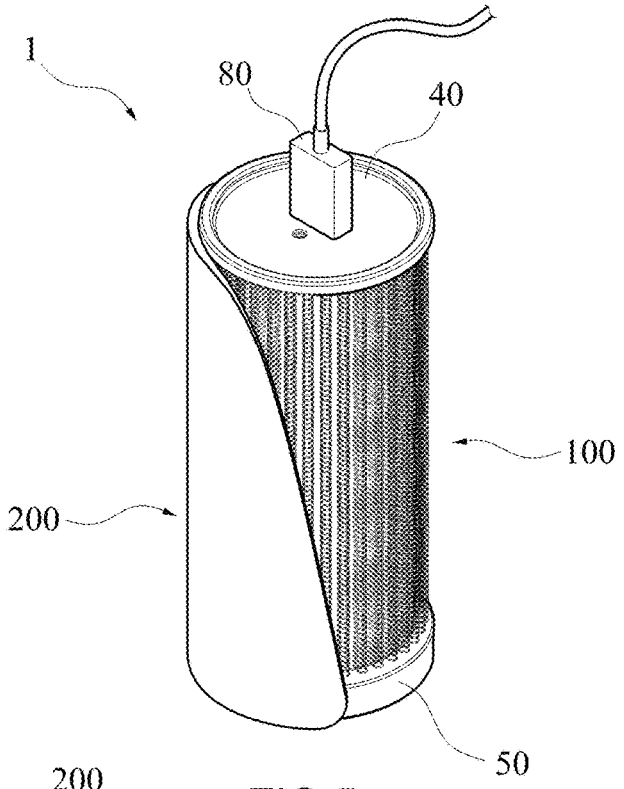
FIG. 5 is a perspective view of the hair curling device according to the preferred embodiment of the invention showing a charging state of the hair curling device.

The power connection terminal 12 of the hair curling mechanism 100 may be implemented as a socket or a USB receptacle. Any type as Type A, Type B, Type-C, Micro-A, Micro-B, Mini-A or Mini-B of the Universal Serial Bus (USB) can be used. Referring to FIG. 5, the power connection terminal 12 is electrically connected to a USB plug 80 for sourcing power therefrom. The power is used to heat the hair curling device 1.

Figure 3:
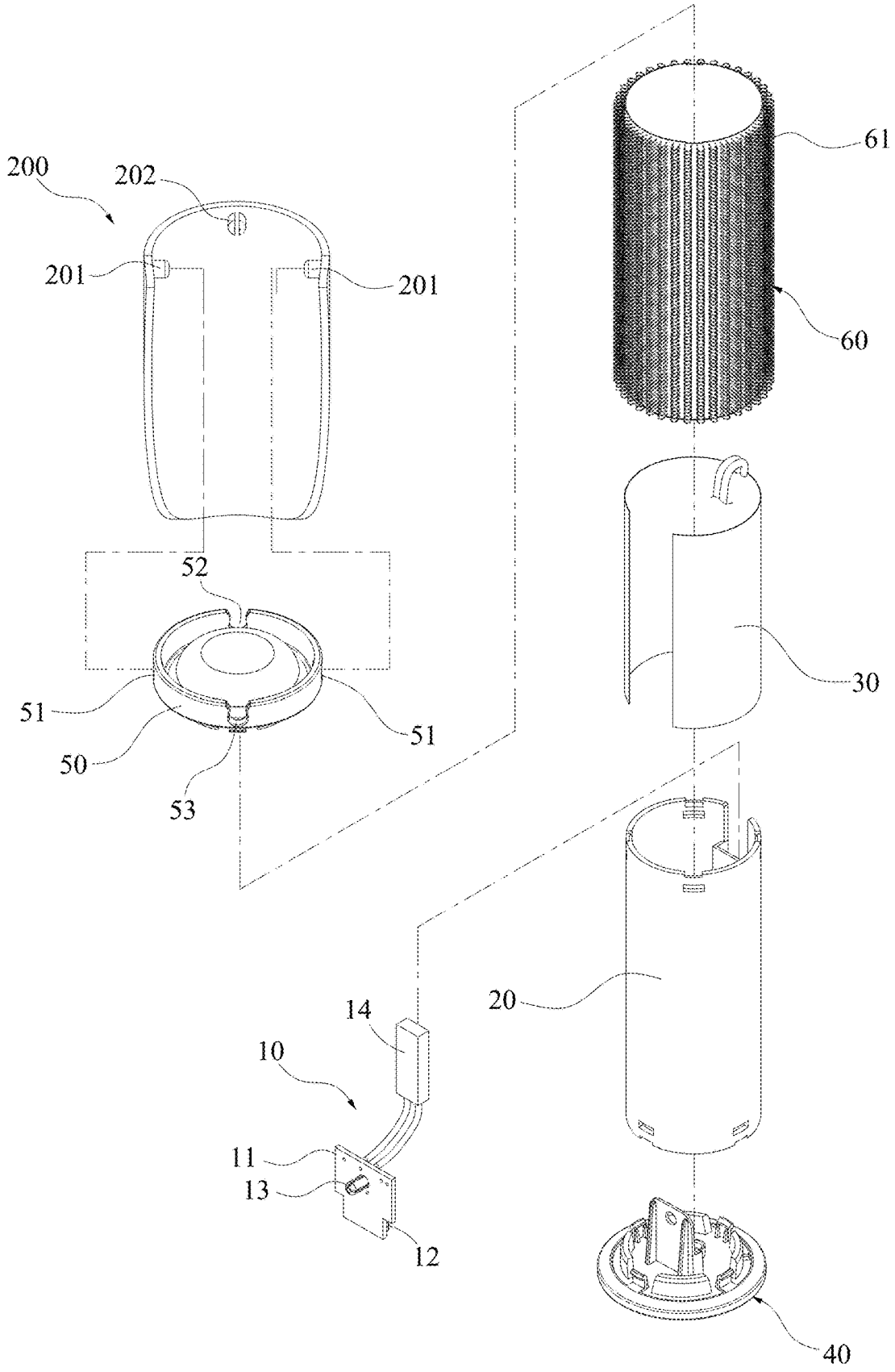
FIG. 3 is an exploded view of hair curling device according to the preferred embodiment of the invention in FIG. 1.
Figure 4:
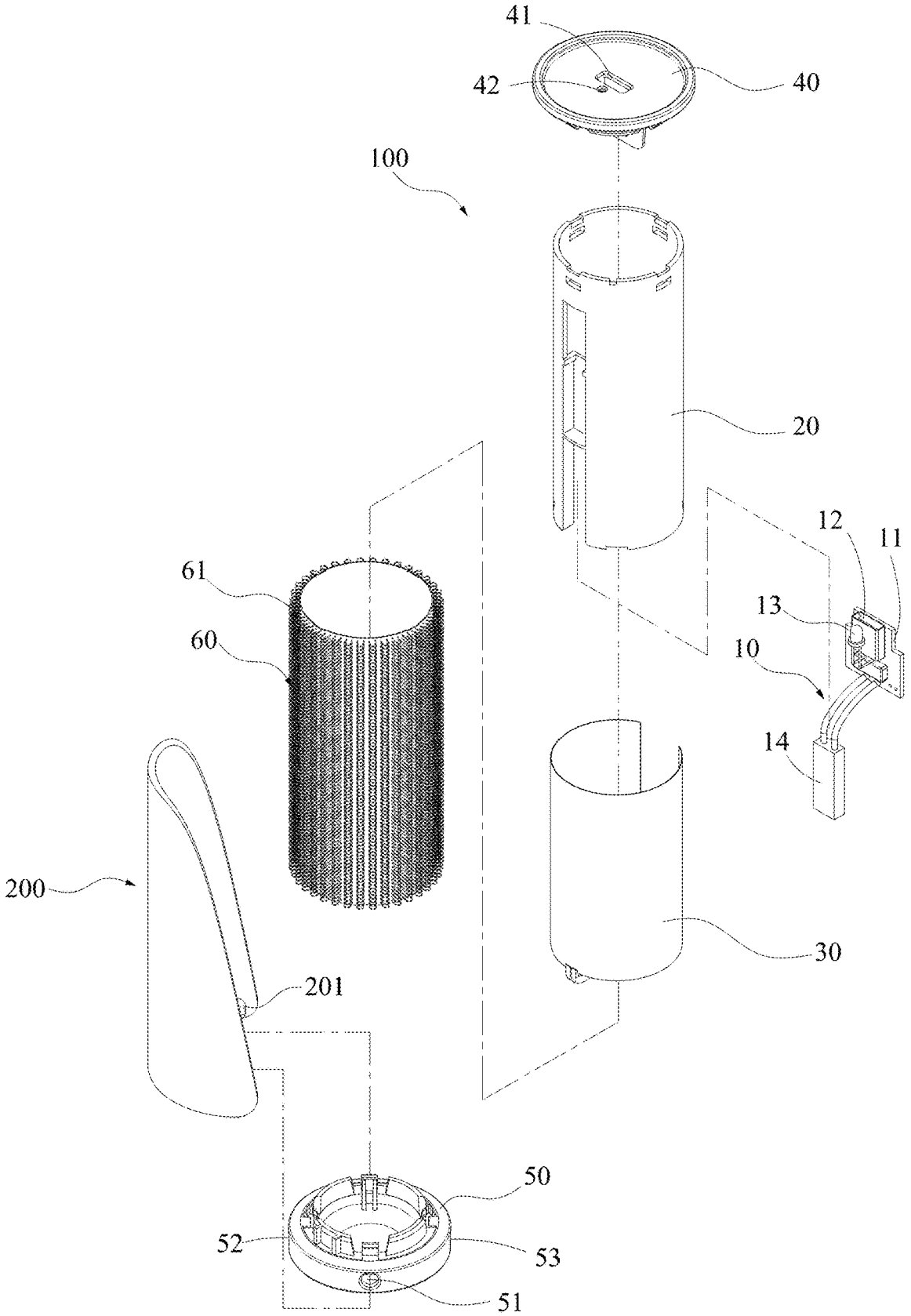
FIG. 4 is an exploded view of hair curling device according to the preferred embodiment of the invention in FIG. 2.
Figure 6:
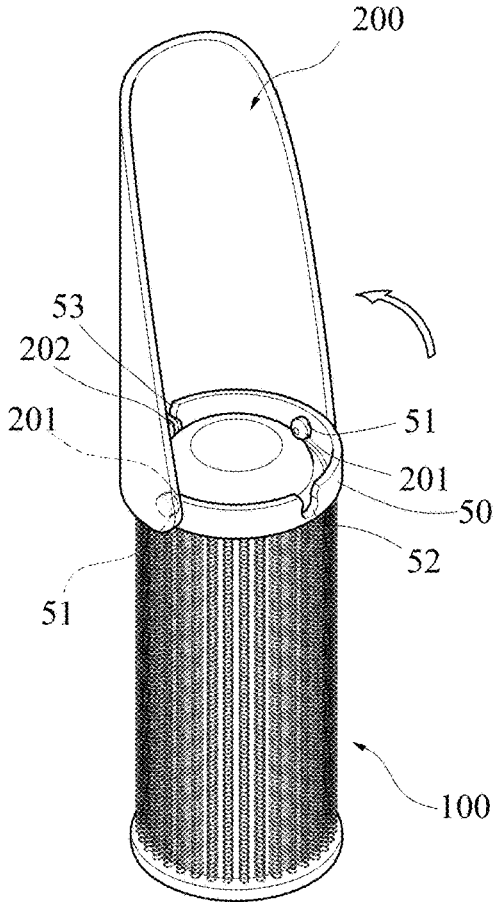
FIG. 6 is a perspective view of the hair curling device according to the preferred embodiment of the invention showing the covering plate being completely open.
Figure 7:
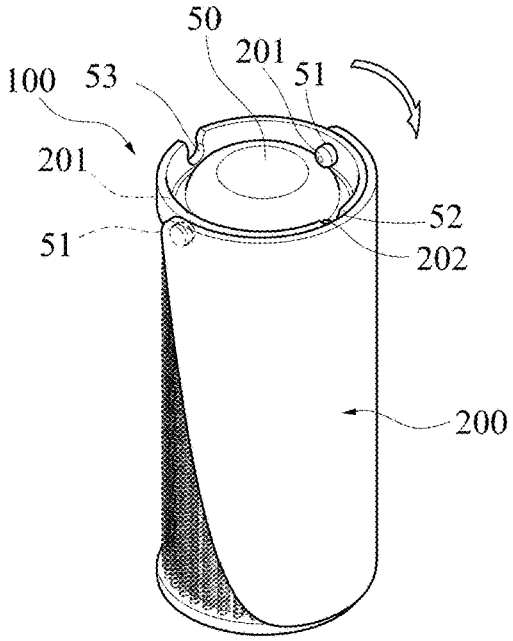
FIG. 7 is a perspective view of the hair curling device according to the preferred embodiment of the invention showing the covering plate being closed.

Referring to FIGS. 6 and 7 in conjunction with FIG. 3, the closing cap 50 on one end of the hair curling mechanism 100 includes two pivot holes 51 on left and right sides respectively. The covering plate 200 includes two pivots 201 on left and right sides which are inserted into the pivot holes 51.

The closing cap 50 includes a front projection 52 and a rear projection 53. The covering plate 200 further comprises a rear projection 202. When the covering plate 200 is closed, the rear projection 202 is locked in the front closing cavity 52, and when the covering plate 200 is open, the rear projection 202 is locked in the rear opening cavity 53. Further, when the covering plate 200 is completely open, the curling cylinder 60 is not covered by the covering plate 200.

Depending on applications, the closing cavity 52 and the opening cavity 53 may be not provided in the front portion and the rear portion of the closing cap 50 but other suitable portion to enable the projections 202 of the covering plate 200 be locking disposed.

Alternatively, only one cavity can be provided by the hair curling device 1 for closing purpose. For example, the cavity is provided on the sealing cap 40 and the projection 202 is provided on an inner surface of a front portion of the covering plate 200. Therefore, the projection 202 can be locking disposed in the cavity of the sealing cap 40 (not shown in the drawing).

When the covering plate 200 is completely open, a hair curling operation can be made easily because the curling cylinder 60 is not covered by the covering plate 200. When the hair curling device 1 is heated, after the hair curled onto the curling cylinder 60, cover the covering plate 200 down for a few minutes, and a perfect curled hair styling is made probability.

The hair curling device of the invention has the following advantages and benefits in comparison with the conventional art: it is easy to use when the hair curling operation is done, and no clip lose situation will happen. Further, heat is sufficiently retained and safe.

While the invention has been described in terms of preferred embodiments, those skilled in the art will recognize that the invention can be practiced with modifications within the spirit and scope of the appended claims.

What is claimed is:

1. A hair curling device, comprising:

a power supply unit including a control circuit board, a power connection terminal and a power indicator both connected to the control circuit board;

a central tube for receiving the power supply unit;

a heating unit disposed externally of the central tube, the heating unit being connected to the power supply unit so that the power supply unit is capable of supplying electricity to the heating unit;

a sealing cap disposed at one end of the central tube, the sealing cap including a main hole for allowing the power connection terminal to be revealed;

a closing cap disposed at the other end of the central tube opposite to the sealing cap;

a curling cylinder put on the heating unit; and a covering plate pivotally secured to the closing cap;

wherein the covering plate is configured to have a closed mode and an open mode relative to the curling cylinder; and wherein when the covering plate is completely open, the curling cylinder is not covered by the covering plate, wherein the sealing cap includes a cavity; and wherein the covering plate further comprises a front projection, when the covering plate is closed, the front projection being locked in the cavity of the sealing cap.

2. The hair curling device of claim 1, wherein the closing cap includes two pivot holes on left and right sides respectively; and wherein the covering plate includes two pivots on left and right sides respectively, the pivots being configured to insert into the pivot holes.

3. The hair curling device of claim 1, wherein the closing cap includes a front closing cavity and a rear opening cavity; and wherein the covering plate further comprises a rear projection, when the covering plate is closed, the rear projection being locked in the front closing cavity, and when the covering plate is open, the rear projection is locked in the rear opening cavity.

4. The hair curling device of claim 1, wherein the covering plate has a section of a curved triangle, a half circle or a polygonal.

5. The hair curling device of claim 1, wherein the surface of the curling cylinder includes a plurality of bristles.

6. The hair curling device of claim 1, wherein the surface of the curling cylinder is a comb-tooth shaped or a smooth surface.

7. The hair curling device of claim 1, wherein the power connection terminal is a socket or a Universal Serial Bus (USB) receptacle.

8. The hair curling device of claim 1, wherein the power supply unit further comprises a thermostat connected to the control circuit board; and wherein the heating unit is a polyimide (PI) film heater.

9. The hair curling device of claim 8, wherein the hair curling mechanism is electrically connected to an adapter.

10. The hair curling device of claim 1, further comprising a heat retaining coating formed on an inner surface of the covering plate for slow down to decrease the temperature drop of the heating unit.

* * * * *